US011358790B2

(12) United States Patent
Kazz

(10) Patent No.: US 11,358,790 B2
(45) Date of Patent: Jun. 14, 2022

(54) SPILL PROOF SUBSTANCE DISPOSAL SYSTEM

(71) Applicant: SUSTAINABLE BIOFUELS LLC, Tucson, AZ (US)

(72) Inventor: Michael Kazz, Tucson, AZ (US)

(73) Assignee: SUSTAINABLE BIOFUELS LLC, Tucson, AZ (US)

( * ) Notice: Subject to any disclaimer, the term of this patent is extended or adjusted under 35 U.S.C. 154(b) by 135 days.

(21) Appl. No.: 16/999,032

(22) Filed: Aug. 20, 2020

(65) Prior Publication Data

US 2022/0055832 A1 Feb. 24, 2022

(51) Int. Cl.

*B65F 1/10* (2006.01)
*B65F 1/12* (2006.01)
*B65F 1/16* (2006.01)

(52) U.S. Cl.

CPC ..... *B65F 1/10* (2013.01); *B65F 1/127* (2013.01); *B65F 1/1646* (2013.01); *B65F 2210/148* (2013.01); *B65F 2240/142* (2013.01); *B65F 2240/152* (2013.01)

(58) Field of Classification Search

CPC ..... B65F 1/10; B65F 1/127; B65F 1/1646; B65F 2210/148; B65F 2240/142; B65F 2240/152

USPC ..... 220/502

See application file for complete search history.

(56) References Cited

U.S. PATENT DOCUMENTS 1,226,634 A * 5/1917 Briese ..... B65F 1/10 220/908
1,239,348 A * 9/1917 Bunnell et al. ..... A24F 19/06 220/908
1,239,427 A * 9/1917 Bunnell et al. ..... B65F 1/1615 220/908
4,387,847 A * 6/1983 Downey ..... B65F 1/10 232/43.1
5,560,512 A * 10/1996 Hahn ..... B65F 1/10 220/825
2020/0237583 A1* 7/2020 Lupia ..... A61F 13/84

* cited by examiner

*Primary Examiner* — J. Gregory Pickett
*Assistant Examiner* — Niki M Eloshway
(74) *Attorney, Agent, or Firm* — Eugene Vamos

(57) ABSTRACT

The Spill Proof Substance Disposal System (95) allows for the storage and removal of liquid (e.g. oils) and semi-liquid substances (e.g. greases) ("stored substances"") being transported in a transfer vessel (90). The Spill Proof Substance Disposal System (95) is vandal and theft proof. The Spill Proof Substance Disposal System (95) provides for a quick and efficient way to store and to remove the stored substances. The Spill Proof Substance Disposal System (95) comprises a container (100), a cradle (200), a hinge (300), and a screen (400). The Spill Proof Substance Disposal System (95) may additionally include a cover (500). The Spill Proof Substance Disposal System (95) may additionally include a lock (600). The Spill Proof Substance Disposal System (95) may further comprise a fast substance removal system (700).

17 Claims, 12 Drawing Sheets

SPILL PROOF SUBSTANCE DISPOSAL SYSTEM

CROSS-REFERENCE TO RELATED APPLICATIONS

Not Applicable

STATEMENT REGARDING FEDERALLY SPONSORED RESEARCH/DEVELOPMENT

Not Applicable

THE NAMES OF THE PARTIES TO A JOINT RESEARCH AGREEMENT

Not Applicable

REFERENCE TO A "SEQUENCE LISTING," A TABLE, OR A COMPUTER PROGRAM

Not Applicable

STATEMENT REGARDING PRIOR DISCLOSURES BY AN INVENTOR OR JOINT INVENTOR

Not Applicable

BACKGROUND OF THE INVENTION

1 Field of Invention

The Spill Proof Substance Disposal System generally relates to the field of Spill Proof Substance Disposal Systems. The Spill Proof Substance Disposal System is geared towards a disposal system for used cooking oils, but it can be used for by a variety of liquid (e.g. oils) and semi-liquid substances (e.g. greases) ("stored substances").

2 Description of Related Art

Oil and grease disposal, whether it be food grade or industrial (petroleum based), often occurs by manually transferring the oil and grease into a recycling container. Various oil disposal containers and methods of transfer are available and can be categorized as follows:

Automatic pump out systems. These systems usually involve a pump that drains oil directly from a fryer or an oil sump directly to a larger storage tank. Although these systems are costly and may require maintenance, they are safer and cleaner than manual transfer methods. These systems also reduce theft and vandalism.

Oil and grease shuttles. Oil and grease shuttles work by draining the fryer into a low profile container. The container is on wheels and can be rolled to the storage container. Once lifted, oil is transferred directly into storage. These systems allow a low profile container for ease of draining oil from a fryer or vehicle which is then wheeled away to the storage tank and emptied manually. The drawback is that the transfer often results in spills.

Conventional oil storage containers. This can be as simple as a fifty-five (55) gallon open top drum or an elaborate heavy duty, secure, theft proof container. All these types of storage containers rely on a manual pour of a transfer vessel (90) to transfer oil into these storage containers. Once again, the drawback is that the pouring of the transfer vessel (90) into the container can result in spillage of the oil and greases contained in the transfer vessel (90).

3 Technical Problems

Automatic pump out systems are by far the superior system but have drawbacks. These systems are costly, ranging between $2,000 to $4,000 to install, and are cost prohibitive for most facilities. In addition, when these systems break down, they are costly to repair. Finally, these systems will not work for certain facilities in which the fryers do not have a way to filter or pump oil. Lastly, many facilities do not have enough oil to justify an automatic system.

However, most facilities that utilize oil and grease shuttles still have messy storage containers, arguably even more than conventional oil storage container systems because it is difficult to control a large volume of oil when it is poured from a long container. This is analogous to what happens when a person tries to drink a yard of ale in a tall glass too fast. This effect often results in spillage or seepage around the storage container, and in many instances, the spillage or seepage absorbs into the ground.

Conventional oil storage containers are the most common systems by far and the one that the proposed invention desires to replace. Most oil containers in this category are a 100 to 200 gallon tank, sometimes a 55 gallon closed or open top drum. To transfer oil, a lid or bung is opened, and the oil within a transfer vessel (90) is then poured into the container. The container (in theory) is kept closed so rainwater cannot get in. Water contamination in oil reduces its value, and when water contamination is present in used cooking oil (yellow grease), it causes rancidity. Water mixed with used motor oil increases the amount of hazardous waste and lowers the motor oil's heating value.

In spite of water contamination's deleterious characteristics, more than one third of all conventional oil storage containers are routinely found with their lids left open; it is more convenient to leave the lid open to empty oil rather than to set the container down to open the lid.

Another problem associated with conventional oil storage containers is their use of screens. The screens are installed inside a funnel or between the lid and the storage container. The purpose of the screen is to keep out solids which can contaminate the oil and greases. However, many screens contribute to spills; once a screen is clogged or filled with sediment/food, additional oil poured spills over the sediment-clogged screen and flows over the sides of the container, leaving a permanent stain and fire hazard.

4 Solution Approaches

The focus of this invention is to improve the safety, cleanliness and cost over the oil disposal containers mentioned above.

BRIEF SUMMARY OF THE INVENTION

The Spill Proof Substance Disposal System (95) comprises a container (100), a cradle (200), a hinge (300), and a screen (400). The Spill Proof Substance Disposal System (95) may additionally include a cover (500). The Spill Proof Substance Disposal System (95) may additionally include a lock (600). The Spill Proof Substance Disposal System (95) may further comprise a fast substance removal system (700).

The Spill Proof Substance Disposal System (95) allows for the storage and removal of liquid (e.g. oils) and semi-liquid substances (e.g. greases) ("stored substances") being transported in a transfer vessel (90). The Spill Proof Substance Disposal System (95) is vandal and theft proof. The Spill Proof Substance Disposal System (95) provides for a quick and efficient way to store and to remove the stored substances.

Removal of the stored substances from the container (100) occurs by removal of the cradle (200). The cradle (200) is held in place with a hinge (300) that secures the cradle (200) to the container (100) in a vandalism and theft proof manner.

DETAILED DESCRIPTION OF THE INVENTION

Figure 1:
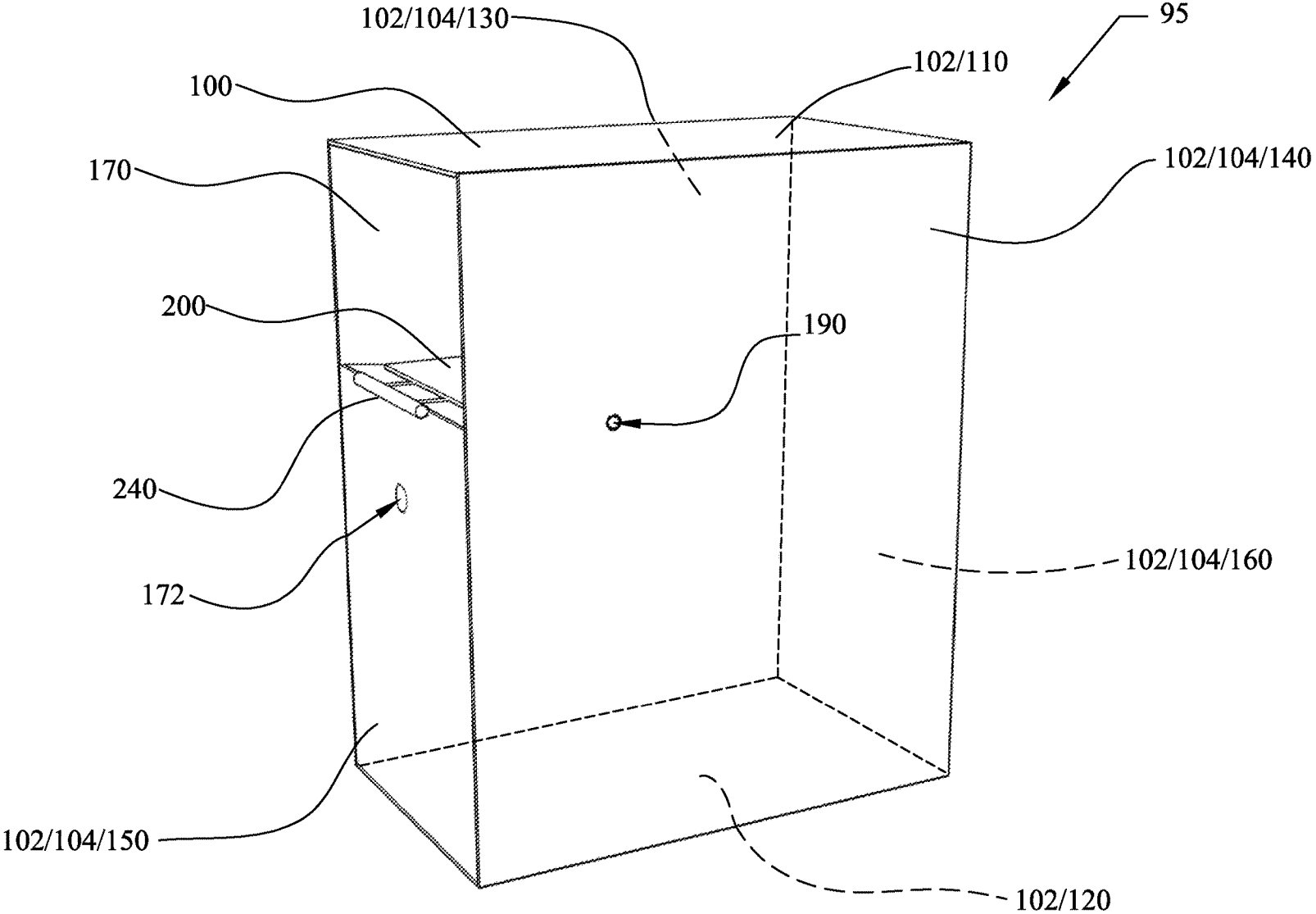
FIG. 1 is a perspective view of the Spill Proof Substance Disposal System (95). The container (100) is in a shape of a rectangular prism, with an cradle access opening (170) co-planar to the front surface (150).

The Spill Proof Substance Disposal System (95) comprises a container (100), a cradle (200), a hinge (300), and a screen (400). The Spill Proof Substance Disposal System (95) may additionally include a cover (500). The Spill Proof Substance Disposal System (95) may additionally include a lock (600). The Spill Proof Substance Disposal System (95) may further comprise a fast substance removal system (700).

The Spill Proof Substance Disposal System (95) allows for the disposal and storage of liquid (e.g. oils) and/or semi-liquid substances (e.g. greases) ("stored substances"). The stored substances may be a homogeneous substance or a solution/mixture of various liquid and/or semi-liquid substances. The Spill Proof Substance Disposal System (95) provides for vandalism and theft proof conditions for the stored substances. In certain circumstance, the Spill Proof Substance Disposal System (95) may be utilized with solid substance such as sand. The Spill Proof Substance Disposal System (95) provides for a quick and efficient way to access and to remove the stored substances.

Removal of the stored substances from the container (100) occurs by removal of the cradle (200). The cradle (200) is held in place with a hinge (300) that secures the cradle (200) to the container (100) in a vandalism and theft proof manner.

The connection of the various elements with each other may be achieved by any state of art techniques, depending on the material selected. For example, if metal is utilized, welding is preferred. Welding creates strong connections that increase integrity and security. Elements may be cast together out of metal, preferably steel.

1 Container (100)

The container (100) allows for the disposal of stored substances into the interior (106) of the container (100). The container (100) comprises one or more surfaces (102), a cradle access opening (170), an inner platform (180), a rod aperture (190), and a lock cover (195). The container (100) may further comprise a fast access opening (172).

The container (100) maybe of a variety of three dimensional shapes, comprising one or more surfaces (102). For example, the container may be a rectangular prism (six surfaces), a sphere (one surface), a cube (six surfaces), a hexagonal prism (eight surfaces), or a pyramid (four surfaces). The container (100) may have either a regular or an irregular shape. FIG. 1 is a perspective view of the Spill Proof Substance Disposal System (95). The container (100) is in a shape of a rectangular prism, with a cradle access opening (170) co-planar to the front surface (150).

A preferred embodiment of the container (100) comprises a top surface (110), a bottom surface (120), and one or more side surfaces (104). For example a rectangular prism comprises six surfaces (102)—a top surface (110), a bottom surface (120), and four side surfaces (104)—a left surface (130), a right surface (140), a front surface (150), and a back surface (160).

The cradle access opening (170) is co-planar to one of the side surfaces (104) of the container (100). The inner platform (180) comprises a front end (182) and a back end (184). The front end (182) of the inner platform (180) is connected to the side surface (104) that is co-planar to the cradle access opening (170), preferably located at the interface between this side surface (104) and the cradle access opening (170). The inner platform (180) projects towards the interior (106) of the container (100).

Locating the cradle access opening (170) on one of the side surfaces (104) allows the top surface (110) to act as a protective element. This protective element keeps out objects that fall with some vertical movement—such as rainwater, leaves, dust—from the interior (106) of the container (100). The cradle access opening (170) is sized to allow a variety of transfer vessels (90) to be inserted through the cradle access opening (170). Larger sized cradle access openings (170) maybe used to accommodate larger transfer vessels (90).

The inner platform (180) may comprise an inner platform notch (186). The inner platform notch (186) is located at the back end (184) of the inner platform (180). The inner platform notch (186) is aligned with the second slot portion (354) of the fastening slot (350). The inner platform notch (186) is used on conjunction with the second slot portion (354), allowing the fastener (340) to rotate down through the second slot portion (354) and the inner platform notch (186) when the back of the cradle (200) hits the fastener (340); this allows the cradle (200) to fully rotate from the disposal position to the load position. The inner platform notch (186) is sized large enough for the fastener (340) to fit through when fastened to the inner fastening aperture (332) of the rod (330).

The stored substances are transferred into the interior (106) of the container (100) through the cradle access opening (170). This is in contrast with traditional oil disposal units, which require a user to pour stored substances onto the top of the traditional oil disposal unit. In a traditional oil disposal unit, a hinged top needs to be opened for the oil to be poured into the container and then closed to keep the elements (water, dirt) out.

The use of a cradle access opening (170) and a top surface (110) eliminates the need to place a transfer vessel (90) on the ground in order to open the hinged top. This difference in oil intake design is significant. More than one third of conventional used cooking oil containers have their lids left open because of this inconvenience, exposing the oil to weather and theft.

A rod aperture (190) is located on one of the side surfaces (104). The rod aperture (190) allows the rod (330) to be inserted into the container (100).

A lock cover (195) is located on the same side surface (104) as the rod aperture (190). The lock cover (195) is located over the rod aperture (190). The lock cover (195) serves to cover and protect the lock (600) from the elements and vandalism when the lock (600) is inserted and locked through the outer fastening aperture (334) of the rod (330). The lock cover (195) is sized large enough to cover and protect the lock (600). The lock cover (195) is connected to the container (100), traditionally via welding; this prevents the tampering of the lock (600). When the lock (600) is locked through the outer fastening aperture (334) within the lock cover (195), it prevents the removal of the rod (330).

Figure 2:
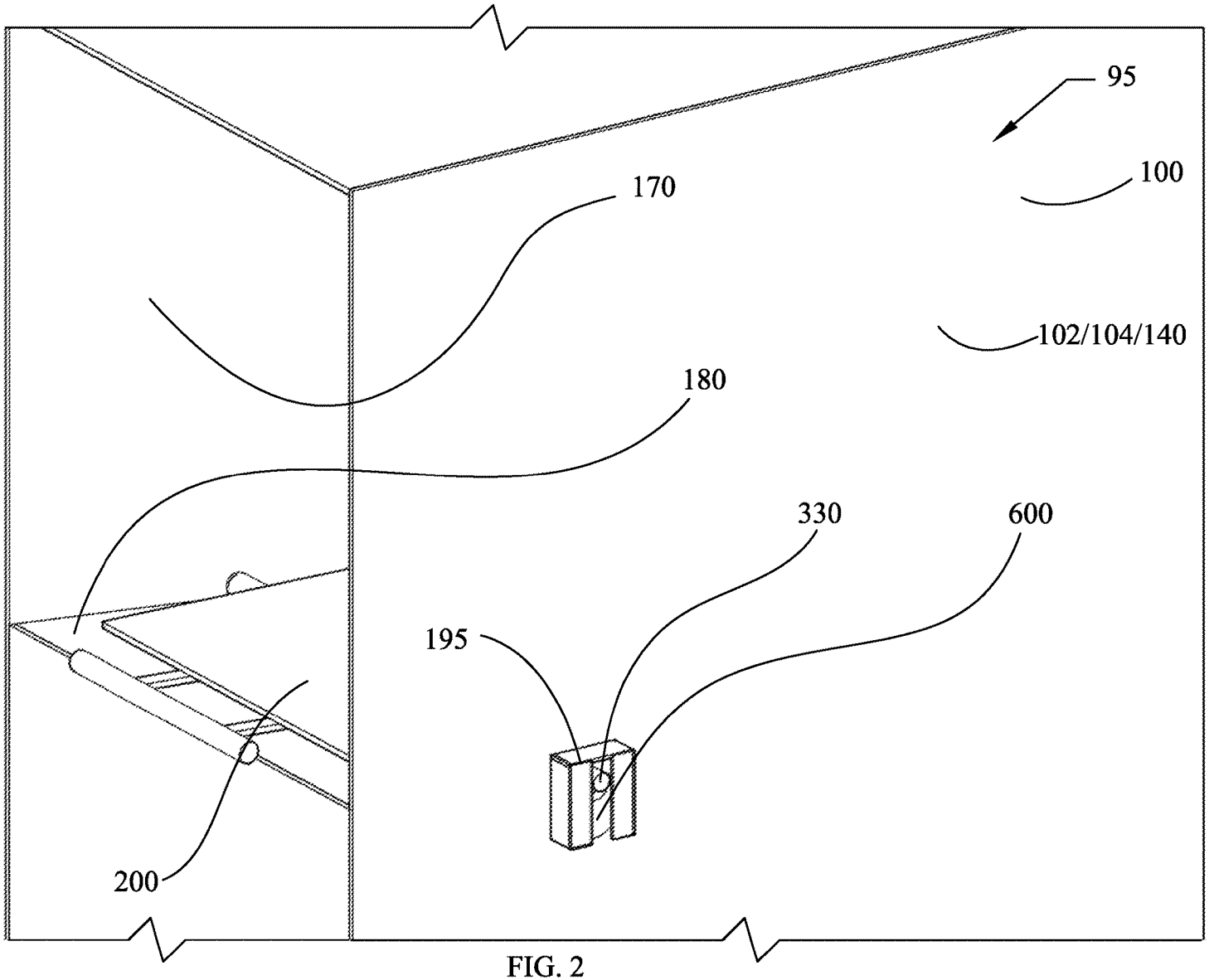
FIG. 2 is a perspective view of the Spill Proof Substance Disposal System (95), revealing the positioning of the lock cover (195) connected to the side surface (104) of the container (100). The lock cover (195) protects a lock (600) that fastens to the rod (330).

The lock cover (195) has a lock cover aperture (197) a) that allows for the rod (330) to access the rod aperture (190) and b) that allows the lock (600) to be placed within the lock cover (195) and to be locked through the outer fastening aperture (334) of the rod (330). FIG. 2 is a perspective view of the Spill Proof Substance Disposal System (95), revealing the positioning of the lock cover (195) connected to the side surface (104) of the container (100). The lock cover (195) protects a lock (600) that fastens to the rod (330).

2 Cradle (200)

The cradle (200) comprises a base surface (210), a support surface (220), a handle (240), a plurality of vessel stabilizing arms (230), and a plurality of support beams (250). The cradle (200) is used to dispose stored substances from a transfer vessel (90) into the interior (106) of the container (100). The base surface (210) provides a place to set the transfer vessel (90) into a load position. When the cradle (200) is rotated approximately 90 degrees (+/− ten degrees) into a disposal position, the transfer vessel (90) is likewise rotated and the contents of the transfer vessel (90) are emptied into the interior (106) of the container (100).

Figure 3:
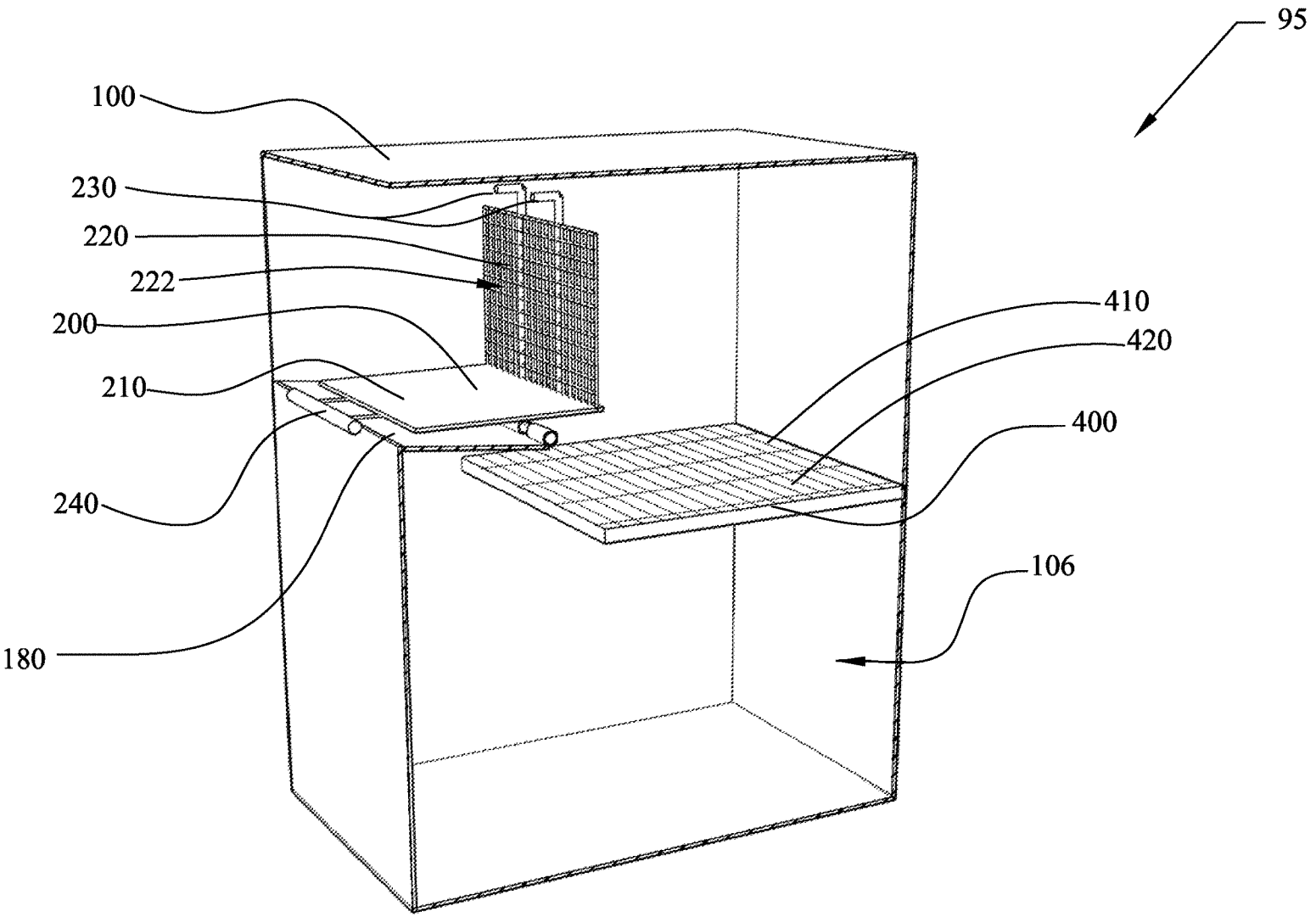
FIG. 3 is a perspective sectional view of the Spill Proof Substance Disposal System (95), revealing the cradle (200) and the screen (400) within the container (100). The cradle (200) is in its load position. The support surface (220) of the cradle (200) is shaped as a grate. The screen (400) is shaped as a grate, which includes bars (410) and apertures (420).

After the transfer vessel (90) has been emptied, the user returns the cradle (200) to its load position by rotating it back. It should be noted that the cradle (200) is balanced in a manner that allows it to remain in the load position. Specifically, the handle (240) is weighted in such a way to counter balance the excess structural weight of the base surface (210) and support surface (220). If the handle (240) was not weighted properly, the cradle (200) would tend to rotate forward into the disposal position. FIG. 3 is a perspective sectional view of the Spill Proof Substance Disposal System (95), revealing the cradle (200) and the screen (400) within the container (100). The cradle (200) is in its load position. The support surface (220) of the cradle (200) is shaped as a grate. The screen (400) is shaped as a grate, which includes bars (410) and apertures (420).

The base surface (210) comprises a front side (212) and a back side (214). The bottom side of the base surface (210) is connected to one or more of the cradle knuckles (310).

Figure 6:
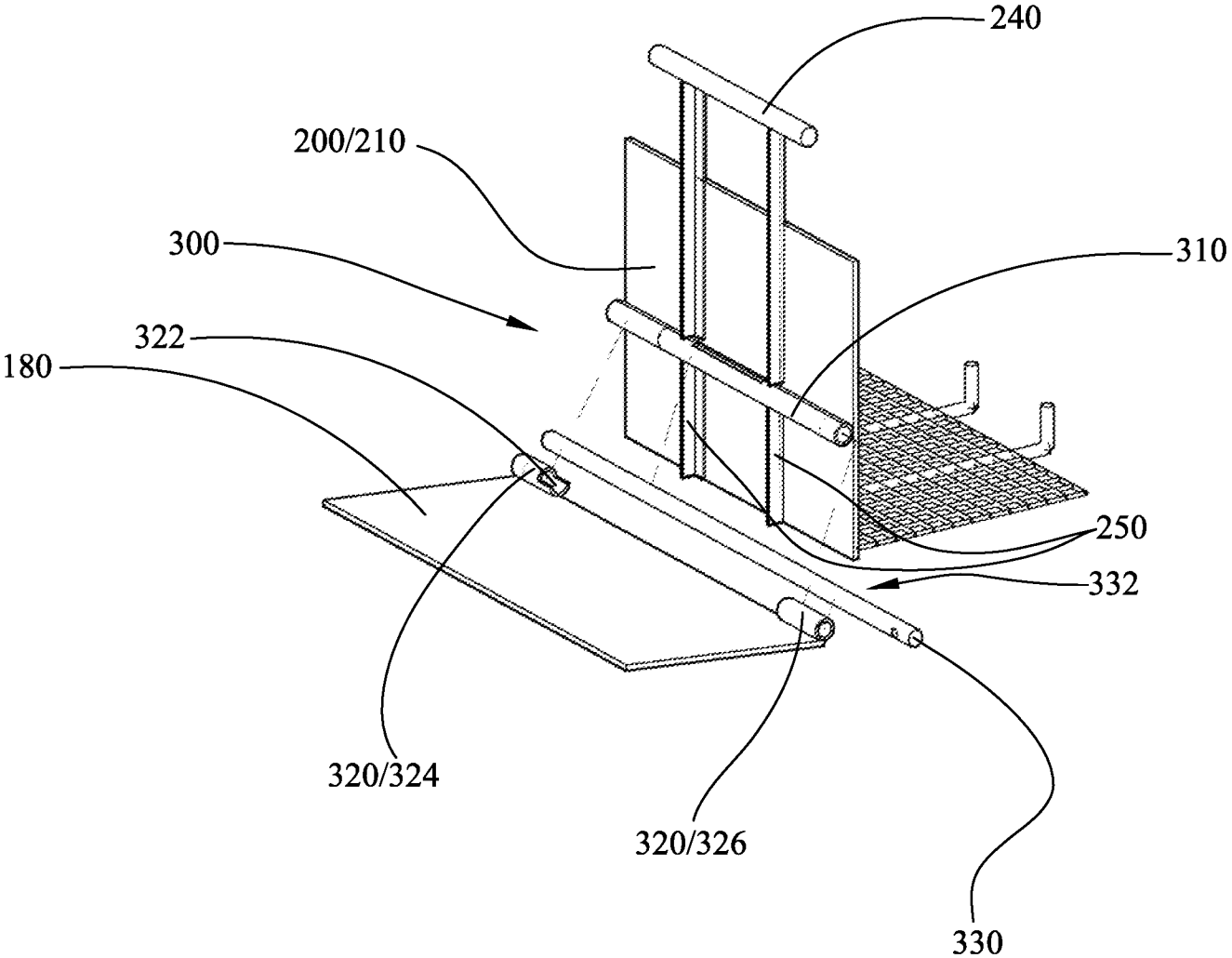
FIG. 6 is a perspective exploded view of the cradle (200) in the disposal position, fastened to the inner platform (180) of the container (100) by the hinge (300). Two container knuckles (320) are connected to the inner platform (180) and one cradle knuckle (310) is connected to the base surface (210) of the cradle (200). The cradle (200) is in a disposal position.

The handle (240) is connected to the base surface (210) at one or more points. In light duty situations, the handle (240) is connected to the front side (212) of the base surface (210). In heavy duty situations, where bigger and heavier transfer vessels (90) are used, the handle (240) is connected to the bottom side of the base surface (210). To provide greater stability, the handle (240) may be connected to one or more of the cradle knuckles (310). FIG. 6 is a perspective exploded view of the cradle (200) in the disposal position, fastened to the inner platform (180) of the container (100) by the hinge (300). The handle (240) is connected to the bottom side of the base surface (210) and the cradle knuckles (310) at two points.

The vessel stabilizing arm (230) is L shaped. The vessel stabilizing arm (230) comprises a first portion (232) and a second portion (236), a first end (233) of the first portion (232) of the vessel stabilizing arm (230) being connected to and extending approximately 90 degrees (+/− ten degrees) to the back side (214) of the base surface (210), the second portion (236) of the vessel stabilizing arm (230) being connected to and extending from a second end (234) of the first portion (232) of the first L-shaped arm in a direction approximately 90 degrees (+/− ten degrees) to the first portion (232) of the vessel stabilizing arm (230).

Figure 5:
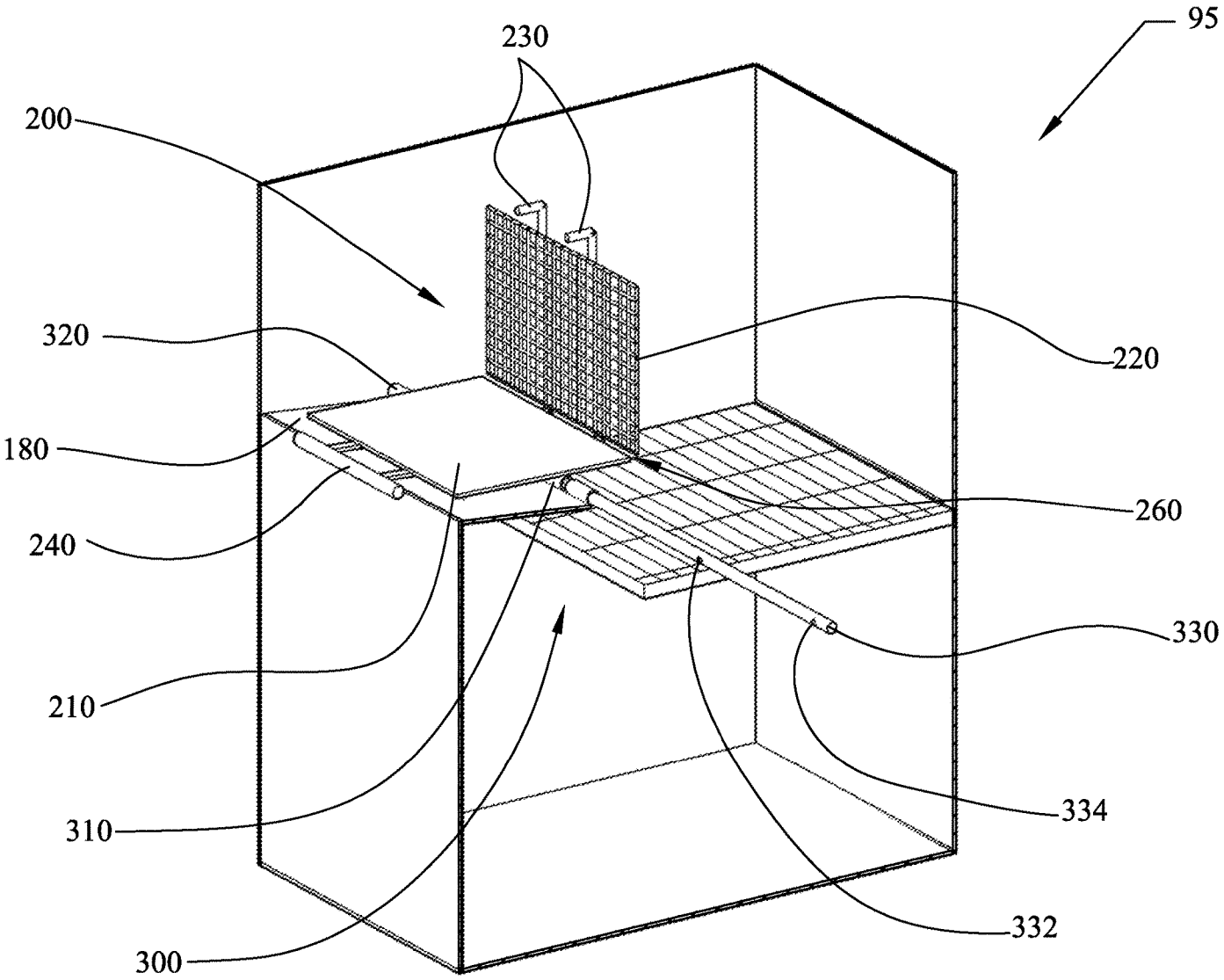
FIG. 5 is a perspective sectional view of the cradle (200) fastened to the inner platform (180) of the container (100) by the hinge (300). The cradle (200) is in the load position. The rod (330) is semi-inserted into the cradle knuckles (310) and the container knuckles (320) of the hinge (300).

The support surface (220) is connected to the first portion (232) of the vessel stabilizing arms (230). The support surface (220) is oriented at approximately 90 degrees (+/− ten degrees) to the base surface (210). The support surface (220) is connected to the vessel stabilizing arms (230) so that it leaves a surface clearance gap (260) between the base surface (210) and support surface (220). FIG. 5 is a perspective sectional view of the Spill Proof Substance Disposal System (95), showing a surface clearance gap (260) between the base surface (210) and support surface (220). Alternatively, the support surface (220) is connected to the vessel stabilizing arms (230) so that there is no space between the base surface (210) and support surface (220). FIG. 3 is a perspective sectional view of the Spill Proof Substance Disposal System (95), showing no space between the base surface (210) and support surface (220). The surface clearance gap (260) allows for simplified cradle (200) assembly and a pathway for stored substances to flow through into the interior (106) of the container (100).

The base surface (210) design (e.g. pattern type, material type and thickness) needs to account for the weight of the transfer vessel (90) plus any stored substances being transported within the transfer vessel (90) without bending, breaking, or tearing. The base surface (210) design may encompass any and all state-of-art characteristics, including but not limited to pattern type (solid, latticed, et cetera), material type (steel, carbon composite, plastics, et cetera) and thickness (thick, thin).

The support surface (220) and the vessel stabilizing arms (230) keep the transfer vessel (90) from falling into the interior (106) of the container (100) and onto the screen (400). The support surface (220) design (e.g. material selection and thickness) needs to allow the stored substances to flow through into the interior (106) of the container (100) but prevent the insertion of a hose through the support surface (220) and permit un-authorized pumping/theft of the stored substances stored in the interior (106) of the container (100). When a transfer vessel (90) is set over the base surface (210) and the cradle (200) is rotated to the disposal position, the transfer vessel (90) lies over the support surface (220) and the second portion (234) of the vessel stabilizing arm (230) prevents the transfer vessel (90) from sliding into the interior (106) of the container (100).

One or more support beams (250) connect to the bottom side of the base surface (210), extending preferentially perpendicular from the cradle knuckles (310) towards the back side (214) of the base surface (210). The support beams (250) provide stability to the base surface (210) by supporting the weight of the transfer vessel (90). The support beams (250) also provide stability to the vessel stabilizing arms (230) that are connected to the back side (214) of the base surface (210). This stability increases where the support beam (250) connection to the base surface (210) is adjacent (within one inch) to the vessel stabilizing arm (230) connection to the base surface (210). The support beams (250) and the vessel stabilizing arm (230) connect to the base surface (210) by state of the art methods, such as welding, which prevents the base surface (210) and the cradle (200) from warping and the vessel stabilizing arm (230) from shearing off.

In one embodiment, the support surface (220) has a one or more apertures (222) that allow the stored substances to flow through into the interior (106) of the container (100). The size of the apertures (222) should be small enough to prevent the insertion of a hose through the apertures (222) and permit un-authorized pumping/theft of the stored substances stored in the interior (106) of the container (100). The thickness between the apertures (222) should be thick enough to maintain material strength and to prevent bending of the material and enlarging the size of the apertures (222) so that a hose cannot be squeezed through the apertures (222). For example, when using wire or bars to create the support surface (220), the gauge should be thick enough to prevent bending and should be spaced no more than the diameter of typical vacuum hoses, approximately 1½ inches apart.

For example, the support surface (220) may be shaped as a grate, that is a framework of parallel or crossed bars or wires such as to allow the flow of the stored substances through the apertures (222). FIG. 3 is a perspective sectional view of the Spill Proof Substance Disposal System (95), revealing the positioning of the cradle (200) and the screen (400) within the container (100). The support surface (220) of the cradle (200) is shaped as a grate, which includes apertures (222). The screen (400) is shaped as a grate, which includes bars (410) and apertures (420).

Figure 4:
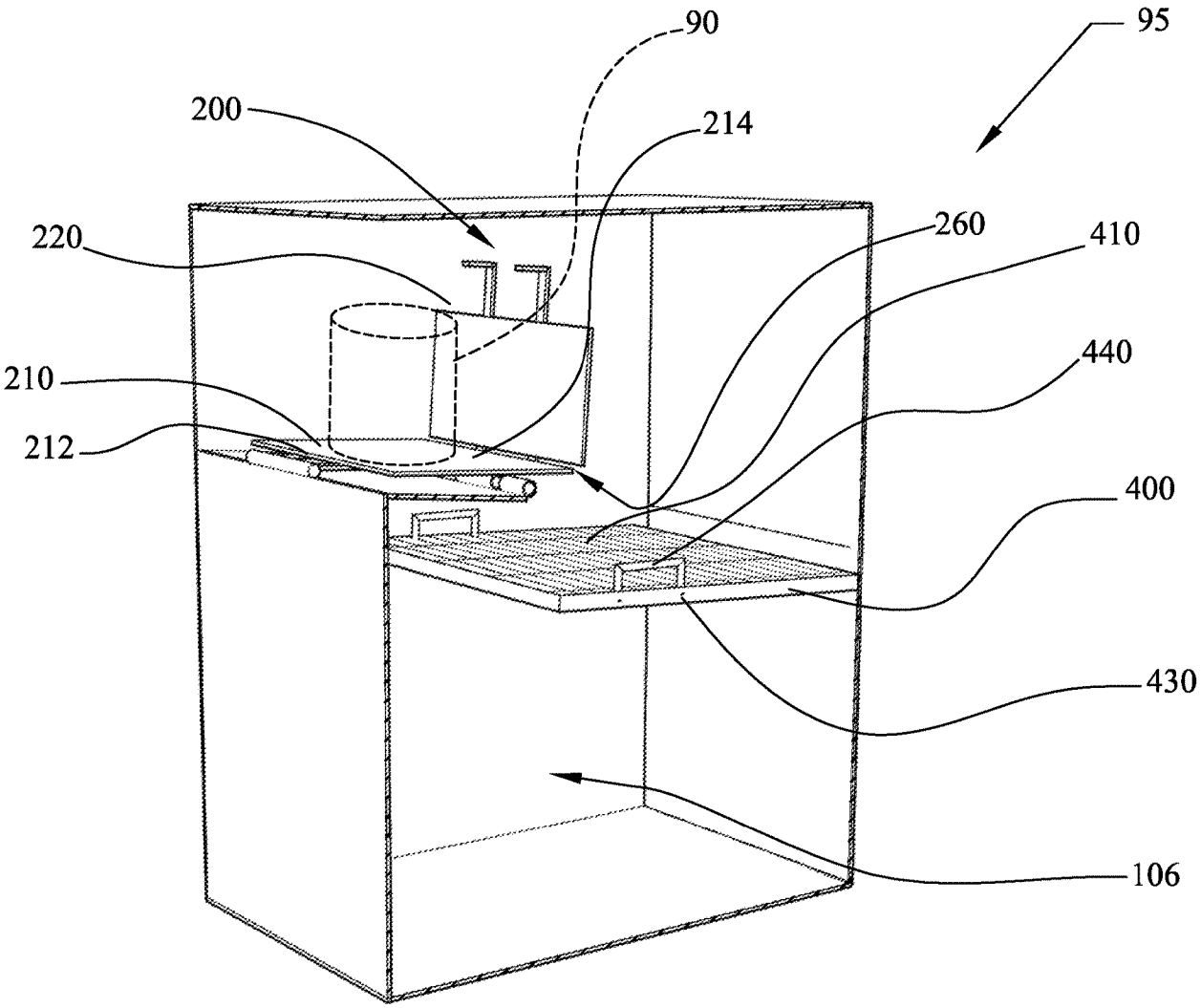
FIG. 4 is a perspective sectional view of the Spill Proof Substance Disposal System (95), revealing the positioning of the cradle (200) and the screen (400) within the container (100). The support surface (220) of the cradle (200) is made out of solid material. The screen (400) has handles (440).

In another embodiment, the support surface (220) is solid. This may be advantageous with particularly wide or heavy containers that need the additional support when emptied. The stored substances within the transfer vessel (90) would flow through alternate pathways such as the sides of the support surface (220) or spacing between the support surface (220) and the base surface (210). FIG. 4 is a perspective sectional view of the Spill Proof Substance Disposal System (95), revealing the positioning of the cradle (200) and the screen (400) within the container (100). The support surface (220) of the cradle (200) is made out of solid material. The screen (400) has handles (440).

The cradle (200) allows emptying the transfer vessel (90) by raising the handle (240) until the base surface (210) of the cradle (200) is rotated approximately 90 degrees (+/− ten degrees) from the load position to the disposal position. The support surface (220) prevents the transfer vessel (90) from being dropped into the screen (400) while the transfer vessel (90) is in its disposal position and the contents of the transfer vessel (90) are being emptied. A portion of each of the vessel stabilizing arm (230) is oriented approximately 90 degrees (+/− ten degrees) from the support surface (220). This orientation of the portion of each vessel stabilizing arms (230) prevent the transfer vessel (90) from sliding from the support surface (220) and falling into the screen (400) while the transfer vessel (90) is in its disposal position and the contents of the transfer vessel (90) are being emptied.

The cradle (200) has two significant features. First, the cradle (200) blocks access to the screen (400) and the interior (106) of the container (100), providing a way to block attempts to steal stored substances from the interior (106) of the container (100). Second, the cradle (200) allows for a comfortable and safe way to dispose stored substances to the container (100). For example, in the restaurant service industry, a transfer vessel (90) such as a 40 quart standard pot can be used to dispose of oil to the container (100) collected from a kitchen fryer.

3 Hinge (300)

The hinge (300) connects the cradle (200) to the container (100). The hinge (300) allows the cradle (200) to rotate from the load position to the disposal position, and vice versa, allows the cradle (200) to rotate from the disposal position to the load position. The hinge (300) comprises a rod (330), one or more cradle knuckles (310), and one or more container knuckles (320). The hinge may further comprise a fastener (340), and a fastening slot (350). The hinge (300) may also comprise an O-ring (360). FIG. 6 is a perspective exploded view of the cradle (200) fastened to the inner platform (180) of the container (100) by the hinge (300). Two container knuckles (320) are connected to the inner platform (180) and one cradle knuckle (310) is connected to the base surface (210) of the cradle (200). The cradle (200) is in a disposal position.

The rod (330) comprises an outer fastening aperture (334), a far side end (336) and an aperture side end (338). The outer fastening aperture (334) extends through the rod (330), enabling the lock (600) to be placed through the outer fastening aperture (334). The outer fastening aperture (334) is usually a ⅜ inch to ⅝ inch hole. The rod (330) is inserted through the rod aperture (190).

The rod (330) may further comprise an inner fastening aperture (332). The fastener (340) fastens into the inner fastening aperture (332).

A knuckle is a hollow portion, typically cylindrical, through which the rod (330) is inserted and removed. The cradle knuckles (310) are connected to the base surface (210) of the cradle (200) on the opposite side where the transfer vessel (90) is placed. The position of the cradle knuckles (310) relative to the front end of the base surface (210) and the back end of the base surface (210)

Figure 10:
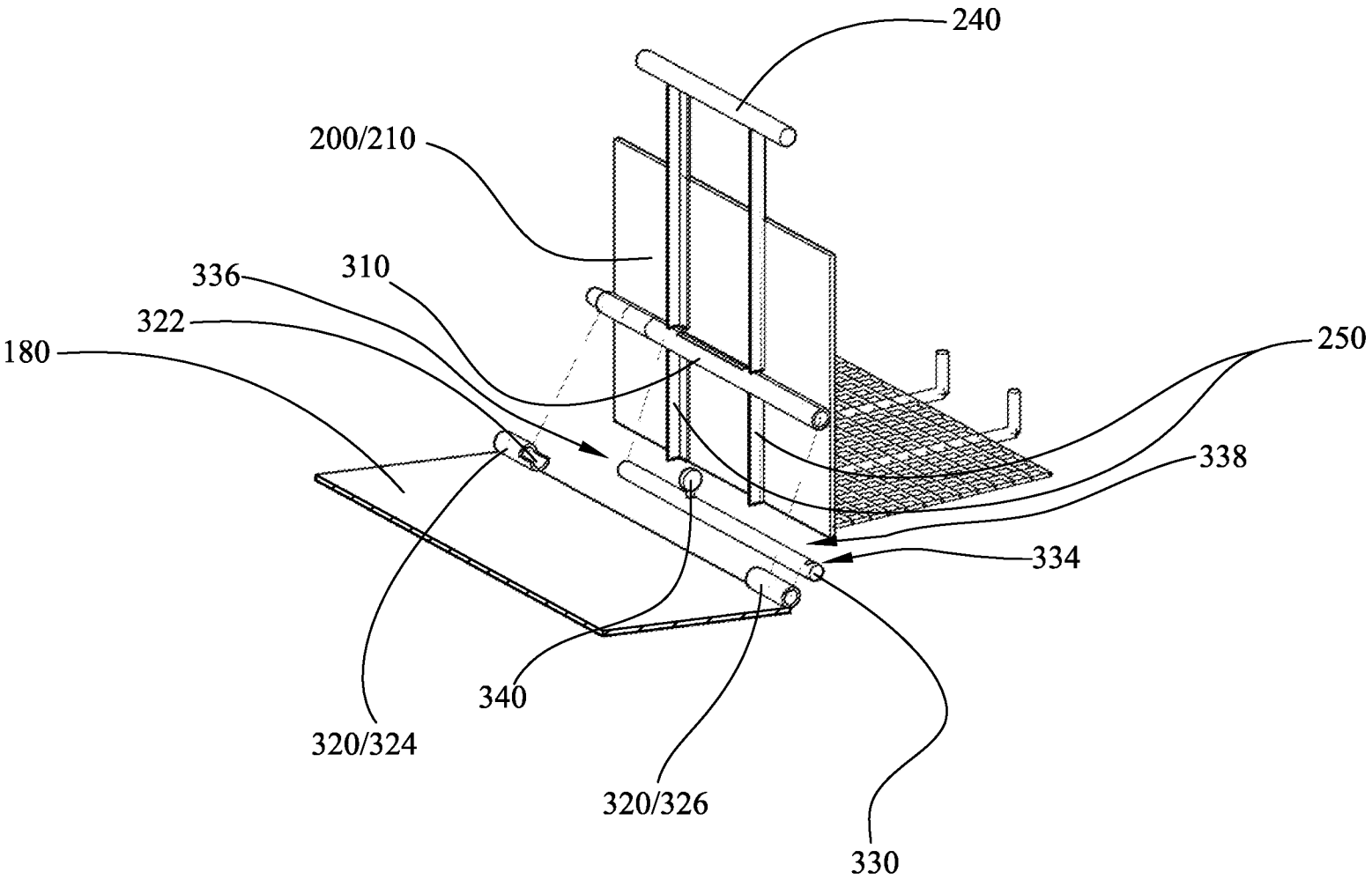
FIG. 10 is a perspective exploded view of the cradle (200) fastened to the inner platform (180) of the container (100) by the hinge (300). Two container knuckles (320) are connected to the inner platform (180) and one cradle knuckle (310) is connected to the base surface (210) of the cradle (200). The cradle (200) is in a disposal position.

The container knuckles (320) are connected to the inner platform (180) of the container (100). For example, two container knuckles (320) may be connected to the inner platform (180) and one cradle knuckle (310) may be connected to the cradle. FIG. 10 is a perspective exploded view of the cradle (200) fastened to the inner platform (180) of the container (100) by the hinge (300). Two container knuckles (320) are connected to the inner platform (180) and one cradle knuckle (310) is connected to the base surface (210) of the cradle (200). The cradle (200) is in a disposal position.

The hollow portions of the cradle knuckles (310) are lined up to the hollow portions of the container knuckles (320), and the rod (330) is inserted through the hollow portions of the cradle knuckles (310) and the hollow portions of the container knuckles (320), forming a rotatable joint, that is the hinge (300). The rod (330) extends through the entirety of the width of the cradle, joining all the hollow portions of the cradle knuckles (310) and the hollow portions of the container knuckles (320). The cradle knuckles (310) rotate about the rod (330); the container knuckles (320) are joined to the inner platform (180) of the container (100) and hold the rod (330) in place.

Figure 9:
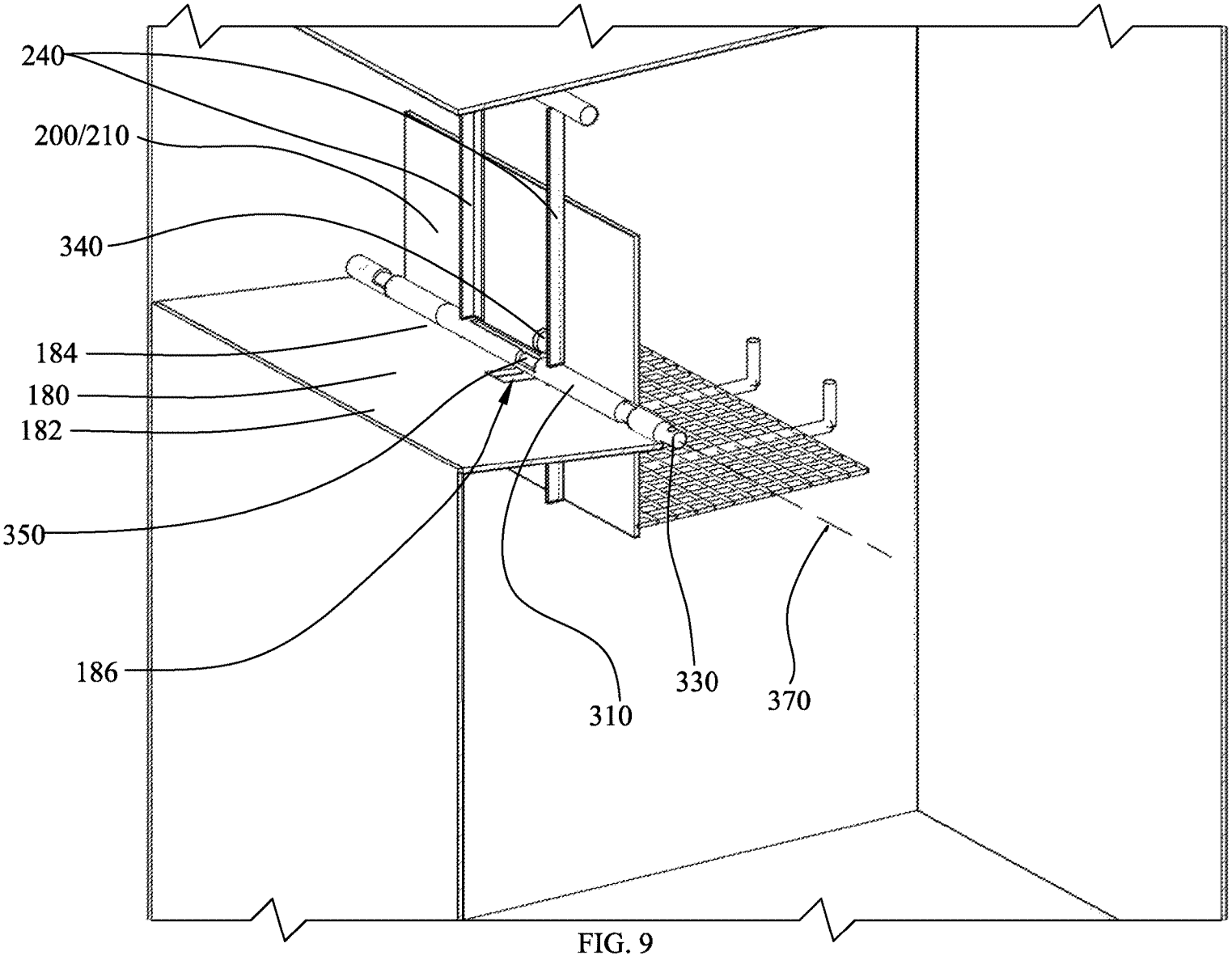
FIG. 9 is a perspective sectional view of the cradle (200) fastened to the inner platform (180) of the container (100) by the hinge (300). The cradle (200) is in a disposal position. The fastener (340) is fastened to the rod (330) through the fastening slot (350) of the cradle knuckle (310).

When the rod (330) is inserted through the rod aperture (190) and through the hollow portions of the cradle knuckles (310) and the hollow portions of the container knuckles (320), the rod (330), the cradle knuckles (310) and the container knuckles (320) share a common rotational axis (370). FIG. 9 shows the common rotational axis (370).

The fastening slot (350) allows the fastener (340) to fasten to the inner fastening aperture (332) of the rod (330). The fastening slot (350) is oriented parallel to the common rotational axis (370). The fastening slot (350) can be either located on the cradle knuckle (310) or the container knuckle (320) and is aligned over the inner fastening aperture (332) of the rod (330). The slotted configuration of the fastening slot (350) allows the inner fastening aperture (332) of the rod (330) to be easily located when fastening the fastener (340) to the inner fastening aperture (332) of the rod (330). When the fastener (340) is fastened to the inner fastening aperture (332) through the fastening slot (350), it prevents the rod (330) from being removed from the container (100). FIG. 9 is a perspective sectional view of the cradle (200) fastened to the inner platform (180) of the container (100) by the hinge (300). The cradle (200) is in a disposal position. The fastener (340) is fastened to the rod (330) through the fastening slot (350) of the cradle knuckle (310).

When the fastener (340) is fastened to the inner fastening aperture (332) of the rod (330), it allows a user to move the rod (330) along the common rotational axis (370), facilitating the insertion of the rod (330) into the container (100) and the removal of the rod (330) out of the container (100).

Figure 7:
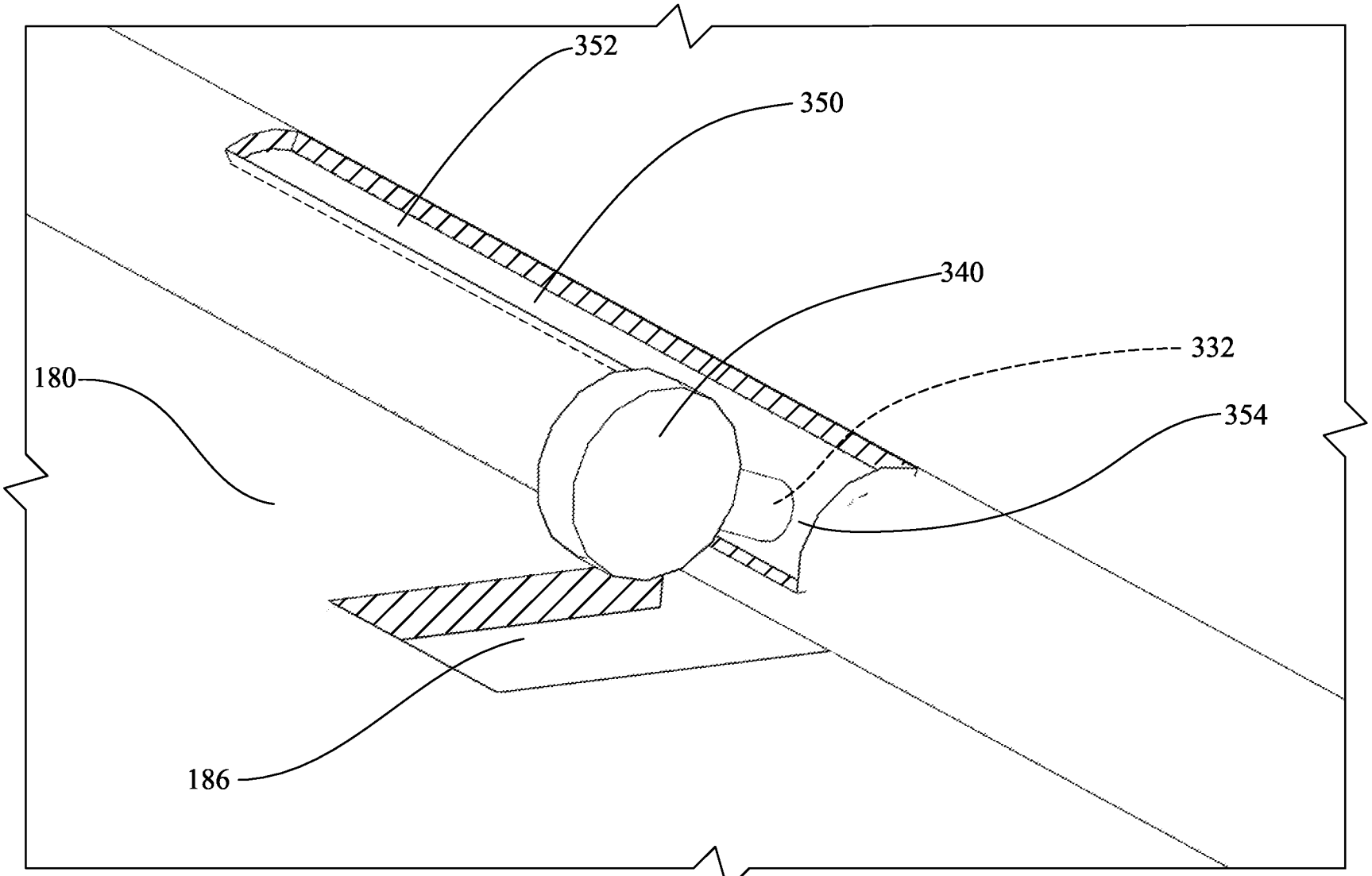
FIG. 7 is a perspective sectional view of an L Shaped fastening slot (350), comprising of a first slot portion (352) and a second slot portion (354). The fastener (340) is fastened to the inner fastening aperture (332).

The fastening slot (350) may be L shaped, comprising of a first slot portion (352) and a second slot portion (354), where the first slot portion (352) is oriented parallel to the common rotational axis (370) and the second slot portion (354) is oriented orthogonal to the common rotational axis (370). The second slot portion (354) allows the fastener (340) to rotate down when the back of the cradle (200) hits the fastener (340), allowing the cradle (200) to fully rotate from the disposal position to the load position. Otherwise, the positioning of the fastening slot (350) and the shape of the fastener (340) may prevent the cradle (200) from reaching the load position. FIG. 7 is a perspective sectional view of an L Shaped fastening slot (350), comprising of a first slot portion (352) and a second slot portion (354). The fastener (340) is fastened to the inner fastening aperture (332).

Figure 8:
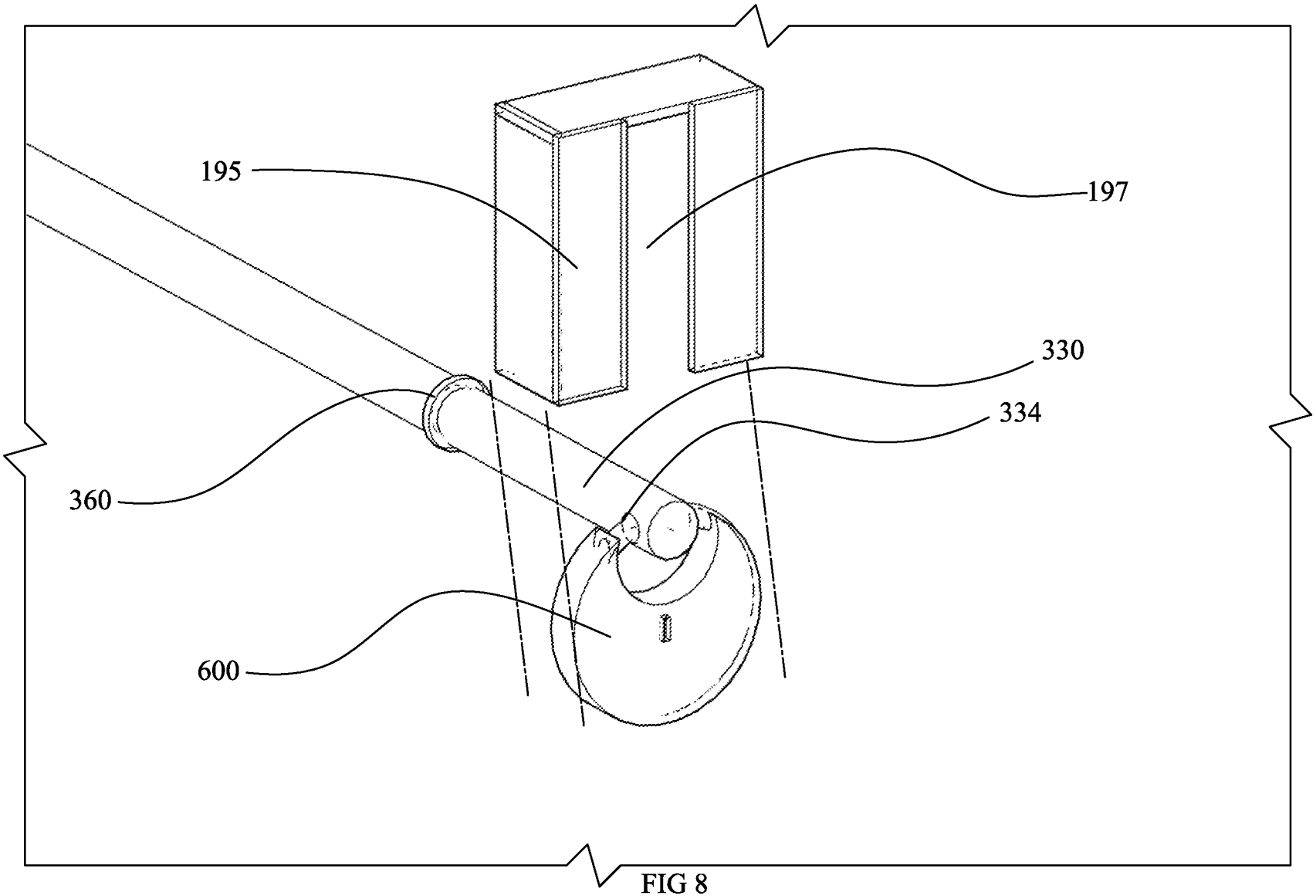
FIG. 8 is an exploded view of the the lock cover (195), which protects the lock (600), and the lock (600) fastened to the rod (330) through its outer fastening aperture (334). The O-Ring (360) is fastened to the rod (330).

An O-ring (360) may also be used to prevent stored substance leakage from the container (100). The O-ring (360) is fastened between the rod (330) and the rod aperture (190), closing any gap that would tend to allow leakage from the interior (106) of the container (100). FIG. 8 is an exploded view of the the lock cover (195), which protects the lock (600), and the lock (600) fastened to the rod (330) through its outer fastening aperture (334). The O-Ring (360) is fastened between the rod (330) and the rod aperture (190).

3.1 First Rod Insertion Embodiment

To insert the rod (330) into the container (100), the cradle (200) is placed over the inner platform (180) and the cradle knuckles (310) are lined up with the container knuckles (320). The rod (330) is inserted through the rod aperture (190) and placed through the the cradle knuckles (310) and the container knuckles (320). A lock (600) is fastened through the outer fastening aperture (334). If an inner fastening aperture (332), a fastener (340), and a fastening slot (350) are present, the fastener (340) is fastened to the inner fastening aperture (332); the fastener (340) is used to properly place the rod (330) within the cradle knuckles (310) and the container knuckles (320); the inner fastening aperture (332) of the rod (330) is located through the fastening slot (350) and the fastener (340) is fastened to the inner fastening aperture (332); the fastener (340) is used to properly place the rod (330) within the cradle knuckles (310) and the container knuckles (320).

To the remove the rod (330) out of the container (100), the lock (600) is unfastened from the outer fastening aperture (334). The rod (330) is removed through the rod aperture (190). The cradle (200) can then be removed from the hinge (300) and the container (100), providing access to the interior (106) of the container (100). If an inner fastening aperture (332), a fastener (340) and a fastening slot (350) are present, the fastener (340) is used to partially remove the rod (330) from the container (100) through the rod aperture (190); the fastener (340) is then unfastened from the inner fastening aperture (332) and the rod (330) is fully removed from the cradle knuckles (310) and the container knuckles (320). FIG. 5 is a perspective sectional view of the cradle (200) fastened to the inner platform (180) of the container (100) by the hinge (300). The cradle (200) is in the load position. The rod (330) is semi-inserted into the cradle knuckles (310) and the container knuckles (320) of the hinge (300).

3.2 Second Rod Insertion Embodiment

Rather than inserting and removing the rod (330) through the rod aperture (190), the hinge (300) may be designed to allow for the rod (330) to be removed through the cradle access opening (170) along with the cradle (200). A first container knuckle (324) connects to the side of the inner platform (180) furthest from the rod aperture (190) and houses the far side end (336) of the rod (330); a second container knuckle (326) connects to the side of the inner platform (180) closest to the rod aperture (190) and houses the aperture side end (338) of the rod (330). The rod (330) length in this second rod insertion embodiment is about two inches shorter than the rod (330) length in the first rod insertion embodiment.

The first container knuckle (324) comprises a knuckle notch (322), which allows the rod (330) to be lifted and pulled out within the container (100) without having to slide the rod (330) out through the rod aperture (190). FIG. 10 is a perspective exploded view of the cradle (200) fastened to the inner platform (180) of the container (100) by the hinge (300). A first container knuckle (324) and a second container knuckle (326) are connected to the inner platform (180) and one cradle knuckle (310) is connected to the base surface (210) of the cradle (200). The cradle (200) is in a disposal position.

To insert the cradle (200) to the container (100), the cradle (200) with the rod (330) placed within the cradle knuckle (310) is inserted through the cradle access opening (170). The far side end (336) of the rod (330) is placed through the knuckle notch (322) and placed into the first container knuckle (324). Using the fastener (340), the aperture side end (338) of the rod (330) is placed into the second container knuckle (326) until the outer fastening aperture (334) appears through the rod aperture (190) outside the container (100). A lock (600) is fastened through the outer fastening aperture (334).

To remove the cradle (200) from the container (100), the lock (600) is unfastened from the outer fastening aperture (334). The cradle (200) is rotated from the load position to the disposal position, revealing the hinge (300). The fastener (340) is used to move the rod (330) until the far side end (336) of the rod (330) is visible through the knuckle notch (322) of the first container knuckle (324). The cradle (200) is pulled up so that the far side end (336) of the rod (330) is removed from the first container knuckle (324). The rod (330) is moved so that the aperture side end (338) of the rod (330) does not lie within the second container knuckle (326). The cradle (200) can then be removed through the cradle access opening (170).

4 Screen (400)

The screen (400) has two main purposes. The first is to separate and capture solids ("contaminants") away from the stored substances: for example, contaminants that degrade cooking oil. The second is to prevent theft by creating a physical barrier to impede a hose to pump the stored substances located on the bottom of the container (100).

The screen (400) maybe bordered on its perimeter by a frame (430). The frame (430) provides structural support, especially when contaminants accumulate over the screen (400). For example, a frame (430) prevents contaminants from spilling out when the screen (400) is removed. The screen (400) covers a cross-sectional area of the container (100). For example, when the container (100) is in the shape of a rectangular prism, the screen (400) is either rectangular or square in shape.

The screen (400) maybe shaped as a grate, which includes bars (410) made from steel or other heavy duty material and approximately ¼ inch to 1 inch apertures (420) to inhibit contaminants from entering the bottom of the container (100). FIG. 3 is a perspective sectional view of the Spill Proof Substance Disposal System (95), revealing the positioning of the cradle (200) and the screen (400) within the container (100). The support surface (220) of the cradle (200) is shaped as a grate. The screen (400) is shaped as a grate, which includes bars (410) and apertures (420).

The screen (400) may have a plurality of handles (440) to allow ease in removal from the container (100). FIG. 4 is a perspective sectional view of the Spill Proof Substance Disposal System (95), revealing the positioning of the cradle (200) and the screen (400) within the container (100). The support surface (220) of the cradle (200) is made out of solid material. The screen (400) has handles (440).

The screen (400) is normally oriented perpendicular to the side surfaces (104) of the container (100). Alternatively, the pitch and/or the roll of the bars (410) may be greater than or less than zero, so that the bars (410) are "tilted"—not perpendicular to the side surfaces (104) of the container (100). This non-zero pitch and/or non-zero roll of the bars (410) allows for greater accumulation of solids and for better drainage of stored substances.

5 Cover (500)

Figure 11:
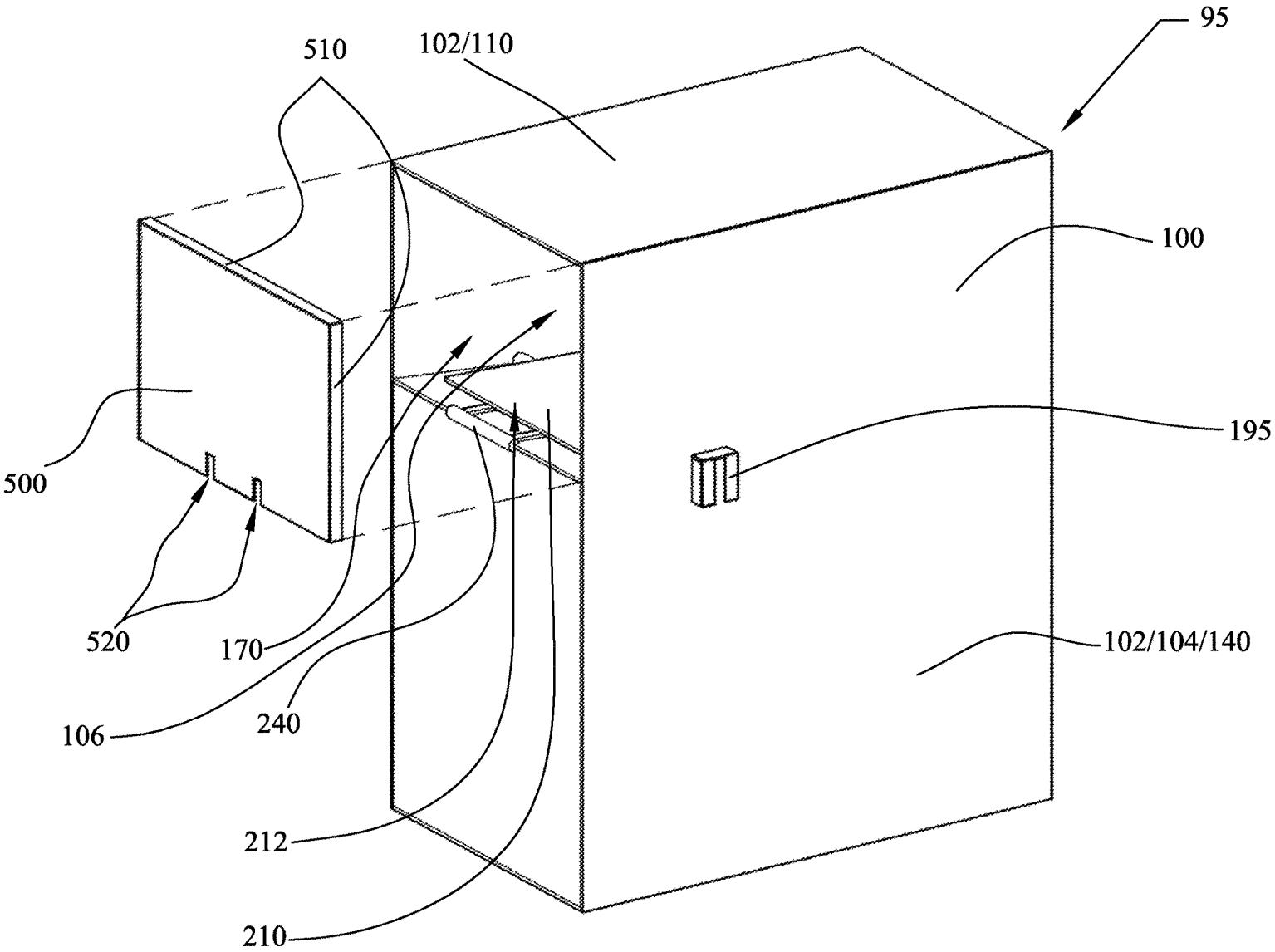
FIG. 11 is an perspective exploded view of the cover (500) covering the cradle access opening (170) of the container (100). The cover (500) has two slots (520) that fit over the handle (240). The lock cover (195) is connected to the right surface (140) of the container (100).
Figure 12:
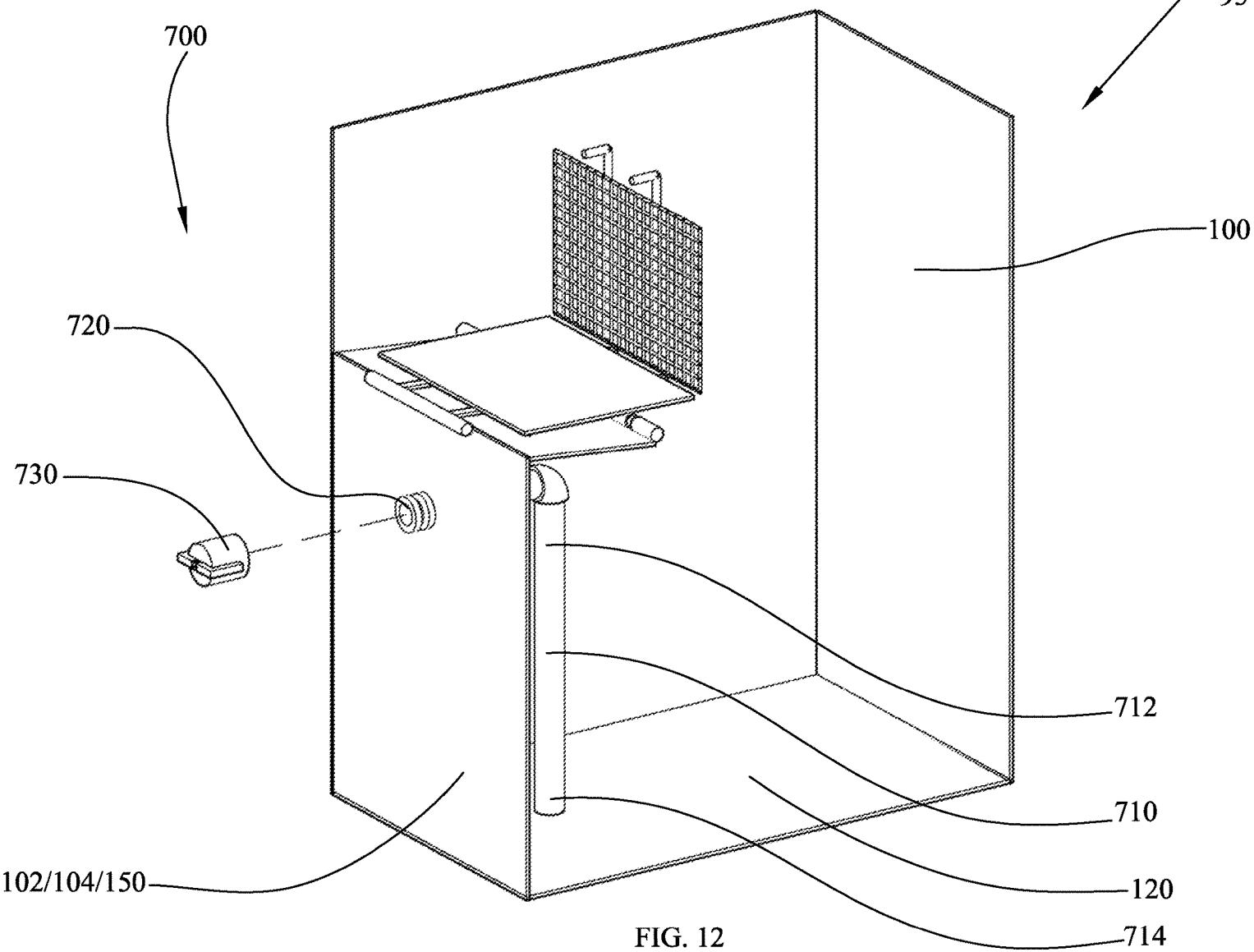
FIG. 12 is a perspective sectional view of the Spill Proof Substance Disposal System (95), revealing the positioning of the cradle (200) and the screen (400) within the container (100).

Some users of the Spill Proof Substance Disposal System (95) may require complete enclosure of the container (100). In extreme weather conditions, when objects may fall with a substantial horizontal movement, these objects may enter the cradle access opening (170) into the interior (106) of the container. In such instances, the Spill Proof Substance Disposal System (95) may further comprise a cover (500) that covers the cradle access opening (170) of the container (100). The cover may have a plurality of flanges (510), oriented perpendicular to the cover (500) so that the flanges (510) fit over the top surface (110) and at least two side surfaces (104). This ensures that the flanges (510) overlap the top surface (110) and the corresponding side surfaces (104). This ensures that the cover (500) completely encloses the cradle access opening (170). This embodiment is suited for applications that require a near air-tight housing, such as when odors or pests are a significant concern. FIG. 11 is an perspective exploded view of the cover (500) covering the cradle access opening (170) of the container (100). The lock cover (195) is connected to the right surface (140) of the container (100).

The cover (500) may further comprise one or more slots (520) that allow the cover (500) to fit around the handle (240). The number of slots (520) correlates to the number of points to which the handle (240) is connected to the front side (212) of the base surface (210). FIG. 11 is an perspective exploded view of the cover (500) covering the cradle access opening (170) of the container (100). The cover (500) has two slots (520) that fit over the handle's (240) two points of contact with the base surface (210) of the cradle (200).

When the cover (500) is part of the Spill Proof Substance Disposal System (95), the user sets down the transfer vessel (90) to remove the cover (500) covering the cradle access opening (170) of the container (100). The user then removes the cover (500) prior to accessing the cradle (200). Once the contents of transfer vessel (90) are disposed into the interior (106) of the container (100), the user places back the cover (500) to cover the cradle access opening (170) of the container (100).

6 Fast Substance Removal System (700)

The fast substance removal system (700) allows removal of the stored substances without having to unlock the cradle (200). This feature is useful when the stored substances are clean and sedimentless, doing away with the need for screening, filtration, and screen (400) scrubbing. The Spill Proof Substance Disposal System (95) may comprise a fast substance removal system (700) when a screen (400) is present or when a screen (400) is not present.

The fast substance removal system (700) comprises a pipe (710), a hose coupler (720) and the container (100) further comprises a fast access opening (172). The fast access opening (172) is located on one of the side surfaces (104) of the container (100) and allows the movement of stored substances within the container (100) to the hose coupler (720).

The pipe (710) comprises a first end (712) and a second end (714). The first end (712) of the pipe (710) is connected to the hose coupler (720). In a first example, the first end (712) of the pipe (700) is connected to the container (100) at the fast access opening (172) and the hose coupler (720) is connected to the container (100) at the fast access opening (172). In a second example, the first end (712) of the pipe (710) extends through the fast access opening (172) and connects directly to the hose coupler (720).

The second end (714) of the pipe (710) is located within the interior (106) of the container (100) and extends towards the bottom surface (120) of the container (100). The second end (714) of the pipe (710) preferably extends to around one inch above the bottom surface (120) of the container (100). The pipe (710) may be straight or be curved. The pipe (710) allows access to stored substances stored within the container (100).

Examples of hose coupler (720) include but are not limited to: a) threaded coupler systems, b) non-threaded coupler systems, c) non-threaded genderless coupler systems, and d) flanged coupling systems. Examples of threaded coupler systems include garden hose thread, GFR, ground joint, Holedall, NH and UNI. Examples of non-threaded coupler systems include camlocks, perrot cardan couplings, British instantaneous couplings, hozelocks, leverlocks, machino, tankwagen flange couplings, and quick-connect garden hose couplings. Examples of non-threaded genderless coupler systems include Air King, Barcelona, DSP, European air coupling, Express coupling, Forestry coupling, Geka steam hose coupling, GOST, Guillemin symmetrical clutch, Hoselink, Nakajima, NOR:las, Nunan and Stove, ROTTA 3-lugs, SFS, SMS 63 FORM and Storz. Examples of flanged coupling systems include Tri-Clamp Connection, and ISC International Shore Connections.

The fast substance removal system (700) may further comprise a lockable cap (730) adapted to couple with the hose coupler (720) connected to the pipe (710). The lockable cap (730) is capable of being secured to the hose coupler (720) with a locking mechanism, preventing access to the hose coupler (720), the pipe (710), the interior (106) of the container (100), and the stored substances stored within the container (100).

To utilize the fast substance removal system (700), the user unlocks the locking cap (730) and removes it from the hose coupler (720). The user proceeds to connect a vacuum hose to the hose coupler (720); the vacuum hose is connected to a vacuuming system. This vacuuming system removes the stored substances stored within the container (100) that are in contact with the second end (714) of the pipe (710).

7 Servicing the Spill Proof Substance Disposal System (95)

7.1 Removing the Cradle (200)

To service the interior (106) of the container (100), the user need to remove the cradle (200) to access the interior (106) of the container (100).

In the first rod insertion embodiment, to the remove the rod (330) out of the container (100), the lock (600) is unfastened from the outer fastening aperture (334). The rod (330) is removed through the rod aperture (190). The cradle (200) can then be removed from the hinge (300) and the container (100), providing access to the interior (106) of the container (100).

In the second rod insertion embodiment, to remove the cradle (200) from the container (100), the lock (600) is unfastened from the outer fastening aperture (334). The cradle (200) is rotated from the load position to the disposal position, revealing the hinge (300). The fastener (340) is used to move the rod (330) until the far side end (336) of the rod (330) is visible through the knuckle notch (322) of the first container knuckle (324). The cradle (200) is pulled up so that the far side end (336) of the rod (330) is removed from the first container knuckle (324). The rod (330) is moved so that the aperture side end (338) of the rod (330) does not lie within the second container knuckle (326). The cradle (200) can then be removed through the cradle access opening (170).

7.2 Servicing the Container (100)

When accessing the interior (106) of the container (100), the user can reach in and remove the screen (400). This allows the user to clean the screen (400) of solid contaminants that have accumulated from usage and place the screen (400) back. Alternatively, the user can replace the screen (400) with another one.

When the screen (400) is removed, the user can remove the contents that have accumulated in the interior (106) of the container (100). When the contents are liquid or semi-liquid, such as motor oil or grease, the user normally uses a hose and a pump.

7.3 Inserting the Cradle (200)

In the first rod insertion embodiment, to insert the rod (330) into the container (100), the cradle (200) is placed over the inner platform (180) and the cradle knuckles (310) are lined up with the container knuckles (320). The rod (330) is inserted through the rod aperture (190) and placed through the the cradle knuckles (310) and the container knuckles (320). A lock (600) is fastened through the outer fastening aperture (334).

In the second rod insertion embodiment, to insert the cradle (200) to the container (100), the cradle (200) with the rod (330) placed within the cradle knuckle (310) is inserted through the cradle access opening (170). The far side end (336) of the rod (330) is placed through the knuckle notch (322) and placed into the first container knuckle (324). Using the fastener (340), the aperture side end (338) of the rod (330) is placed into the second container knuckle (326) until the outer fastening aperture (334) appears through the rod aperture (190) outside the container (100). A lock (600) is fastened through the outer fastening aperture (334).

7.4 Additional Comments

The Spill Proof Substance Disposal System (95) allows the cradle (200) to be locked to the container (100). This is in contrast to most other oil disposal systems, which lock a screen or a cover to prevent theft and environmental contamination.

The Spill Proof Substance Disposal System (95) allows a user to dispose stored substances with no extra equipment, minimal effort, and cleaner results. The Spill Proof Substance Disposal System (95) works with transfer vessels (90) the user already owns. There is no need to purchase extra equipment such as a shortening shuttle. The Spill Proof Substance Disposal System (95) eliminates extra steps such as the "lifting the lid step" and the "pour and aim" step, which require substantial strength and coordination. The Spill Proof Substance Disposal System (95) is efficient and prevents spillage to the surrounding area. Other disposal systems that rely on uncontrolled pouring create environmental issues such as spills when the user pours a liquid into these disposal systems.

The Spill Proof Substance Disposal System (95) does not try to change the behavior of a user, but rather, adapt to the user's natural movements. Furthermore, most other disposal systems focus on the security and theft proof aspect of the container but they do nothing regarding safety or ease of use; the Spill Proof Substance Disposal System (95) provides for these factors.

8 Clarifying Comments

While the foregoing written description of the invention enables a person having ordinary skill in the art to make and use what is considered presently to be the best mode thereof, those of ordinary skill in the art will understand and appreciate the existence of variations, combinations, and equivalents of the specific embodiment, process, and examples herein. The invention should, therefore, not be limited by the above described embodiment, process, and examples, but by all embodiments and processes within the scope and spirit of the invention.

I claim:

1. A spill proof substance disposal system comprising:

(a) a container, the container comprising:
- (i) an interior;
- (ii) a top surface;
- (iii) a bottom surface;
- (iv) one or more side surfaces;
- (v) an access opening, where the access opening is coplanar to one of the side surfaces;
- (vi) an inner platform; where the inner platform is connected to the side surface that is coplanar to the access opening;
- (vii) a lock cover;
- (viii) a rod aperture;
- (ix) where the rod aperture is located on one of the side surfaces,
- (x) where the lock cover is connected to the side surface where the rod aperture is located, (b) a cradle, the cradle comprising:
- (i) a base surface;
- (ii) a support surface;
- (iii) one or more vessel stabilizing arms;
- (iv) one or more support beams;
- (v) a handle; where the handle is connected to the base surface,
- (vi) where the one or more vessel stabilizing arms are connected to the base surface,
- (vii) where the support surface is connected to the one or more vessel stabilizing arms,
- (viii) where the one or more support beams is connected to the base surface, (c) a hinge, the hinge comprising:
- (i) one or more cradle knuckles, where each cradle knuckles is connected to the base surface and to the one or more support beams;
- (ii) one or more container knuckles, where each container knuckles is connected to the inner platform;
- (iii) a fastening slot; where the fastening slot is located on either one of the cradle knuckles or one of the container knuckle,
- (iv) a rod; the rod comprising:
  - (1) an inner fastening aperture; where the fastening slot is aligned over the inner fastening aperture of the rod,
  - (2) an outer fastening aperture;
  - (3) a far side end;
  - (4) an aperture side end;
  - (5) where the outer fastening aperture is located on the aperture side end of the rod,
- (v) a fastener; where the fastener fastens into the inner fastening aperture,
- (vi) where the rod inserts through the rod aperture and each of the cradle knuckles and each of the container knuckles.

2. The disposal system described in claim 1, (a) further comprising: a fast substance removal system; the fast substance removal system comprising
- (i) a pipe; the pipe comprising a first end and a second end; and
- (ii) a hose coupler; where the hose coupler is connected to the first end of the pipe (b) wherein the container further comprises: a fast access opening;

(c) where the fast access opening is located on one of the side surfaces of the container, (d) where the pipe is placed through the fast access opening, (e) where the second end of the pipe is located within the interior of the container and extends towards the bottom surface of the container.

3. The disposal system described in claim 2, (a) wherein the fast substance removal system further comprises:
- (i) a locking cap;
- (ii) where the locking cap is adapted to fasten to the hose coupler.

4. The disposal system described in claim 1, further comprising:

(a) a screen; where the screen is located in the interior of the container.

5. The disposal system described in claim 4

(a) wherein the fastening slot comprises: a first slot portion and a second slot portion,
- (i) where the first slot portion is oriented parallel to the common rotational axis of the rod, the cradle knuckle, and the container knuckles,
- (ii) where the second slot portion is oriented orthogonal to the common rotational axis, (b) wherein the inner platform comprises:
- (i) an inner platform notch;
- (ii) a front end; and
- (iii) a back end;
- (iv) where the inner platform notch is located on the back end of the inner platform, (c) where the the inner platform notch is aligned with the second slot portion of the fastening slot.

6. The disposal system described in claim 4, (a) wherein the hinge comprises: a first container knuckle and a second container knuckle;
- (i) the first container knuckle comprising: a knuckle notch;

(b) where the first container knuckle is connected to the side of the inner platform furthest from the rod aperture and houses the far side end of the rod, (c) where the second container knuckle is connected to the side of the inner platform closest to the rod aperture and houses the aperture side end of the rod.

7. The disposal system described in claim 4, further comprising:

(a) a cover; the cover comprising: one or more slots, (b) where the cover is sized to cover the cradle access opening of the container, (c) where the one or more slots allow the cover to fit around the handle.

8. The disposal system described in claim 7, (a) wherein the cover further comprises: a plurality of flanges;

(b) where the plurality of flanges are oriented perpendicular to the cover so that the flanges fit over the top surface and at least two side surfaces when the cover fits over the cradle access opening.

9. The disposal system described in claim 4, (a) wherein the hinge further comprises: an O-Ring, (b) where the O-ring is fastened between the rod and the rod aperture.

10. An improved spill proof substance disposal system comprising:

(a) a container, the container comprising:

(i) an interior;

(ii) a top surface;

(iii) a bottom surface;

(iv) one or more side surfaces;

(v) an access opening; where the access opening is coplanar to one of the side surfaces, (vi) an inner platform; where the inner platform is connected to the side surface that is coplanar to the access opening, (vii) a lock cover;

(viii) a rod aperture;

(ix) where the lock cover is connected to the side surface where the rod aperture is located, (b) a cradle, the cradle comprising:

(i) a base surface;

(ii) a support surface;

(iii) one or more vessel stabilizing arms;

(iv) one or more support beams;

(v) a handle; where the handle is connected to the base surface, (vi) where the one or more vessel stabilizing arms are connected to the base surface, (vii) where the support surface is connected to the one or more vessel stabilizing arms, (viii) where the one or more support beams is connected to the base surface, (c) a hinge, the hinge comprising:

(i) one or more cradle knuckles; where each cradle knuckle is connected to the base surface and to the one or more support beams, (ii) one or more container knuckles; where each container knuckle is connected to the inner platform, (iii) a rod, the rod comprising:

(1) an outer fastening aperture;

(2) a far side end;

(3) an aperture side end;

(4) where the outer fastening aperture is located on the aperture side end of the rod, (iv) where the rod inserts through the rod aperture and each of the cradle knuckles and each of the container knuckles.

11. The disposal system described in claim 10, (a) further comprising a fast substance removal system; the fast substance removal system comprising (i) a pipe; the pipe comprising a first end and a second end; and (ii) a hose coupler; where the hose coupler is connected to the first end of the pipe (b) wherein the container further comprises: a fast access opening;

(c) where the fast access opening is located on one of the side surfaces of the container, (d) where the pipe is placed through the fast access opening, (e) where the second end of the pipe is located within the interior of the container and extends towards the bottom surface of the container.

12. The disposal system described in claim 11, (a) wherein the fast substance removal system further comprises:

(i) a locking cap;

(ii) where the locking cap is adapted to fasten to the hose coupler.

13. The disposal system described in claim 10, further comprising:

(a) a screen; where the screen is located in the interior of the container.

14. The disposal system described in claim 13, (a) wherein the hinge comprises: a first container knuckle and a second container knuckle;

(i) the first container knuckle comprising: a knuckle notch;

(b) where the first container knuckle is connected to the side of the inner platform furthest from the rod aperture and houses the far side end of the rod, (c) where the second container knuckle is connected to the side of the inner platform closest to the rod aperture and houses the aperture side end of the rod.

15. The disposal system described in claim 13, further comprising:

(a) a cover, the cover comprising: one or more slots;

(b) where the cover is sized to cover the cradle access opening of the container, (c) where the one or more slots allow the cover to fit around the handle.

16. The disposal system described in claim 15, (a) wherein the cover further comprises: a plurality of flanges;

(b) where the plurality of flanges are oriented perpendicular to the cover so that the flanges fit over the top surface and at least two side surfaces when the cover fits over the cradle access opening.

17. The disposal system described in claim 13, (a) wherein the hinge further comprises: an O-Ring;

(b) where the O-ring is fastened between the rod and the rod aperture.

* * * * *